US010132187B2

(12) United States Patent
Tatman et al.

(10) Patent No.: US 10,132,187 B2
(45) Date of Patent: Nov. 20, 2018

(54) CLEARANCE CONTROL ASSEMBLY

(71) Applicant: United Technologies Corporation, Hartford, CT (US)

(72) Inventors: Neil L. Tatman, Brentwood, NH (US); Philip Robert Rioux, North Berwick, ME (US)

(73) Assignee: United Technologies Corporation, Farmington, CT (US)

( * ) Notice: Subject to any disclaimer, the term of this patent is extended or adjusted under 35 U.S.C. 154(b) by 378 days.

(21) Appl. No.: 14/910,341

(22) PCT Filed: Aug. 7, 2014

(86) PCT No.: PCT/US2014/050041
§ 371 (c)(1),
(2) Date: Feb. 5, 2016

(87) PCT Pub. No.: WO2015/021222
PCT Pub. Date: Feb. 12, 2015

(65) Prior Publication Data

US 2016/0186596 A1 Jun. 30, 2016

Related U.S. Application Data

(60) Provisional application No. 61/863,109, filed on Aug. 7, 2013.

(51) Int. Cl.

| | |
|---|---|
| ***F01D 11/16*** | (2006.01) |
| ***F01D 25/24*** | (2006.01) |
| ***F01D 11/18*** | (2006.01) |

(52) U.S. Cl.
CPC ..... *F01D 11/16* (2013.01); *F01D 11/18* (2013.01); *F01D 25/246* (2013.01); *F05D 2220/32* (2013.01); *F05D 2240/11* (2013.01); *F05D 2300/175* (2013.01); *F05D 2300/50212* (2013.01)

(58) Field of Classification Search
CPC . F01D 11/16; F01D 11/18; F05D 2300/50212
See application file for complete search history.

(56) References Cited

U.S. PATENT DOCUMENTS

| | | | |
|---|---|---|---|
| 5,127,793 | A | 6/1992 | Walker et al. |
| 5,281,085 | A | 1/1994 | Lenahan et al. |
| 5,639,210 | A | 6/1997 | Carpenter et al. |
| 6,368,054 | B1 | 4/2002 | Lucas |

(Continued)

FOREIGN PATENT DOCUMENTS

| | | |
|---|---|---|
| EP | 1508673 | 2/2005 |

OTHER PUBLICATIONS

Supplementary European Search Report for Application No. 14833899.9 dated Jan. 30, 2017.

(Continued)

*Primary Examiner* — David E Sosnowski
*Assistant Examiner* — Juan G Flores
(74) *Attorney, Agent, or Firm* — Carlson, Gaskey & Olds, P.C.

(57) ABSTRACT

A clearance control assembly for a gas turbine engine includes a clearance control ring to position a blade outer air seal assembly radially relative to a blade tip. The clearance control ring is compression fit to the blade outer air seal assembly.

18 Claims, 4 Drawing Sheets

(56) References Cited

U.S. PATENT DOCUMENTS

| | | | | |
|---|---|---|---|---|
| 6,848,885 | B1 * | 2/2005 | Maclean | F01D 25/24 415/115 |
| 7,165,937 | B2 | 1/2007 | Dong et al. | |
| 7,195,452 | B2 | 3/2007 | Allan et al. | |
| 7,329,101 | B2 * | 2/2008 | Carper | C04B 35/565 416/219 R |
| 2007/0020095 | A1 | 1/2007 | Dierksmeier et al. | |
| 2010/0104433 | A1 | 4/2010 | Shi et al. | |
| 2012/0243977 | A1 | 9/2012 | Simonet | |
| 2012/0247124 | A1 | 10/2012 | Shapiro et al. | |
| 2012/0275898 | A1 | 11/2012 | McCaffrey et al. | |
| 2016/0123172 | A1 * | 5/2016 | Mondal | F01D 11/025 415/136 |

OTHER PUBLICATIONS

International Search Report and Written Opinion for PCT Application No. PCT/US2014/050041, dated Dec. 26, 2014.
International Preliminary Report on Patentability for Application No. PCT/US2014/050041 dated Feb. 18, 2016.

* cited by examiner

CLEARANCE CONTROL ASSEMBLY

CROSS-REFERENCE TO RELATED APPLICATION

This application claims priority to U.S. Provisional Application No. 61/863,109 filed on Aug. 7, 2013.

BACKGROUND

This disclosure relates to controlling clearances within a gas turbine engine and, more particularly, to control of clearances between blade tips and blade outer air seals.

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

A speed reduction device such as an epicyclical gear assembly may be utilized to drive the fan section such that the fan section may rotate at a speed different and typically slower than the turbine section so as to provide a reduced part count approach for increasing the overall propulsive efficiency of the engine. In such engine architectures, a shaft driven by one of the turbine sections provides an input to the epicyclical gear assembly that drives the fan section at a reduced speed such that both the turbine section and the fan section can rotate at closer to optimal speeds.

The compressor sections and turbine sections of the gas turbine engine include arrays of rotatable blades. Tips of the blades seal against blade outer air seals during operation. One factor influencing the efficiency of the operating engine are the clearances between tips of the blades and the relatively stationary blade outer air seals.

Referring to prior art FIG. 1, many gas turbine engines include clearance control rings 4 to control the position of the blade outer air seals 6 relative to the rotating arrays of blades 8. Current bolted flange arrangements 4 are difficult to machine and assemble. Current bolted flanges 4 restrict capability to adjust to achieve specific blade tip clearances.

SUMMARY

A clearance control assembly for a gas turbine engine according to an exemplary aspect of the present disclosure includes, among other things, a clearance control ring to position a blade outer air seal assembly radially relative to a blade tip. The clearance control ring is compression fit to the blade outer air seal assembly.

In a further non-limiting embodiment of the foregoing clearance control assembly, the clearance control ring is compression fit to a radially outward facing land of the blade outer air seal assembly.

In a further non-limiting embodiment of the foregoing clearance control assembly, the clearance control ring is positioned axially between a radially extending flange of the blade outer air seal and an inner diffuser case.

In a further non-limiting embodiment of the foregoing clearance control assembly, the clearance control ring has a generally "T" shaped cross section.

In a further non-limiting embodiment of the foregoing clearance control assembly, the clearance control ring comprises a cap portion and a stem portion extending radially from the cap portion. The stem portion has an axial width that is less than an axial width of the cap portion.

In a further non-limiting embodiment of the foregoing clearance control assembly, the stem portion is radially inside the cap portion.

In a further non-limiting embodiment of the foregoing clearance control assembly, the clearance control ring is mechanically unfastened.

A clearance control assembly for a gas turbine engine according to another exemplary aspect of the present disclosure includes, among other things, a blade outer air seal assembly mechanically fastened to a gas turbine engine structure. The assembly further includes a clearance control ring to position the blade outer air seal relative to an array of blade tips. The clearance control ring is compression fit to the blade outer air seal.

In a further non-limiting embodiment of the foregoing clearance control assembly, the blade outer air seal assembly comprises an axial span connecting a seal portion to fastener flange.

In a further non-limiting embodiment of the foregoing clearance control assembly, the fastener flange is positioned upstream a vane array relative to a direction of flow through the gas turbine engine and the seal portion is positioned downstream the vane array.

In a further non-limiting embodiment of the foregoing clearance control assembly, the blade outer air seal assembly includes a ring alignment flange that limits movement of the clearance control ring in a first axial direction.

In a further non-limiting embodiment of the foregoing clearance control assembly, the assembly includes a spacer that limits movement of the clearance control ring in a second axial direction opposite the first axial direction.

In a further non-limiting embodiment of the foregoing clearance control assembly, the spacer is positioned axially between an inner diffuser case and the clearance control ring.

In a further non-limiting embodiment of the foregoing clearance control assembly, blade outer air seal comprises a first material having a first coefficient of thermal expansion, and the clearance control ring comprises a second material having a second coefficient of thermal expansion that is different than the first coefficient of thermal expansion.

In a further non-limiting embodiment of the foregoing clearance control assembly, the second material comprises a superalloy.

In a further non-limiting embodiment of the foregoing clearance control assembly, the assembly includes a heat shield radially outside the clearance control ring, the heat shield including a portion directly contacting the clearance control ring.

A method of controlling blade tip clearances within a gas turbine engine according to another exemplary aspect of this disclosure includes, among other things, compression fitting a clearance control ring to a blade outer air seal assembly, and contracting the clearance control ring to limit radial expansion of the blade outer air seal.

In a further non-limiting embodiment of the foregoing method, the method includes limiting axial movement of the clearance control ring using flange extending radially from the blade outer air seal assembly.

In a further non-limiting embodiment of the foregoing clearance control assembly, the method includes mechanically fastening the blade outer air seal to a gas turbine engine structure at a first position, and contacting the clearance control ring at a second position, the first and second positions on opposing axial sides of a vane of the gas turbine engine.

DETAILED DESCRIPTION

Figure 1:
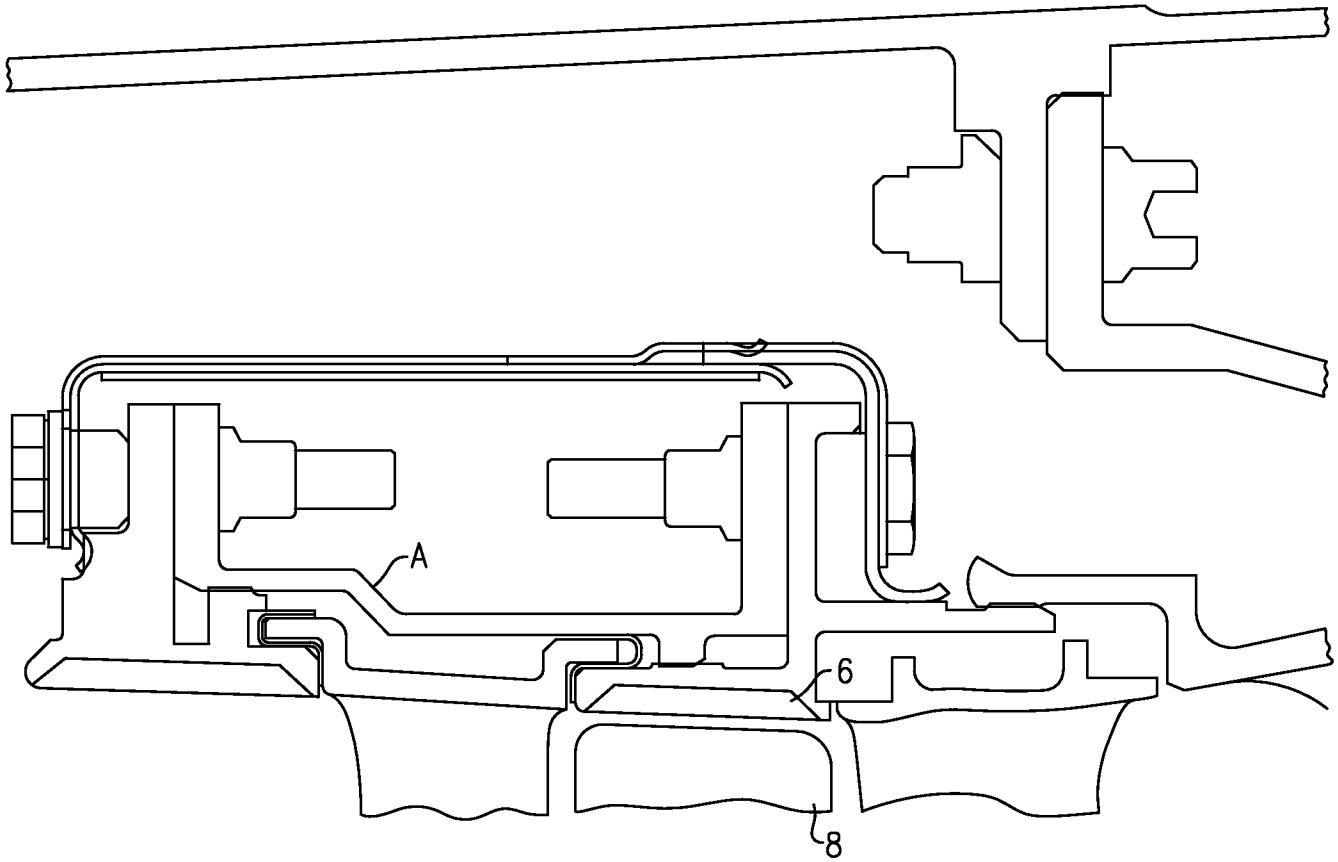
FIG.1 Prior Art
FIG. 1 shows a section view of a prior art clearance control assembly.
Figure 2:
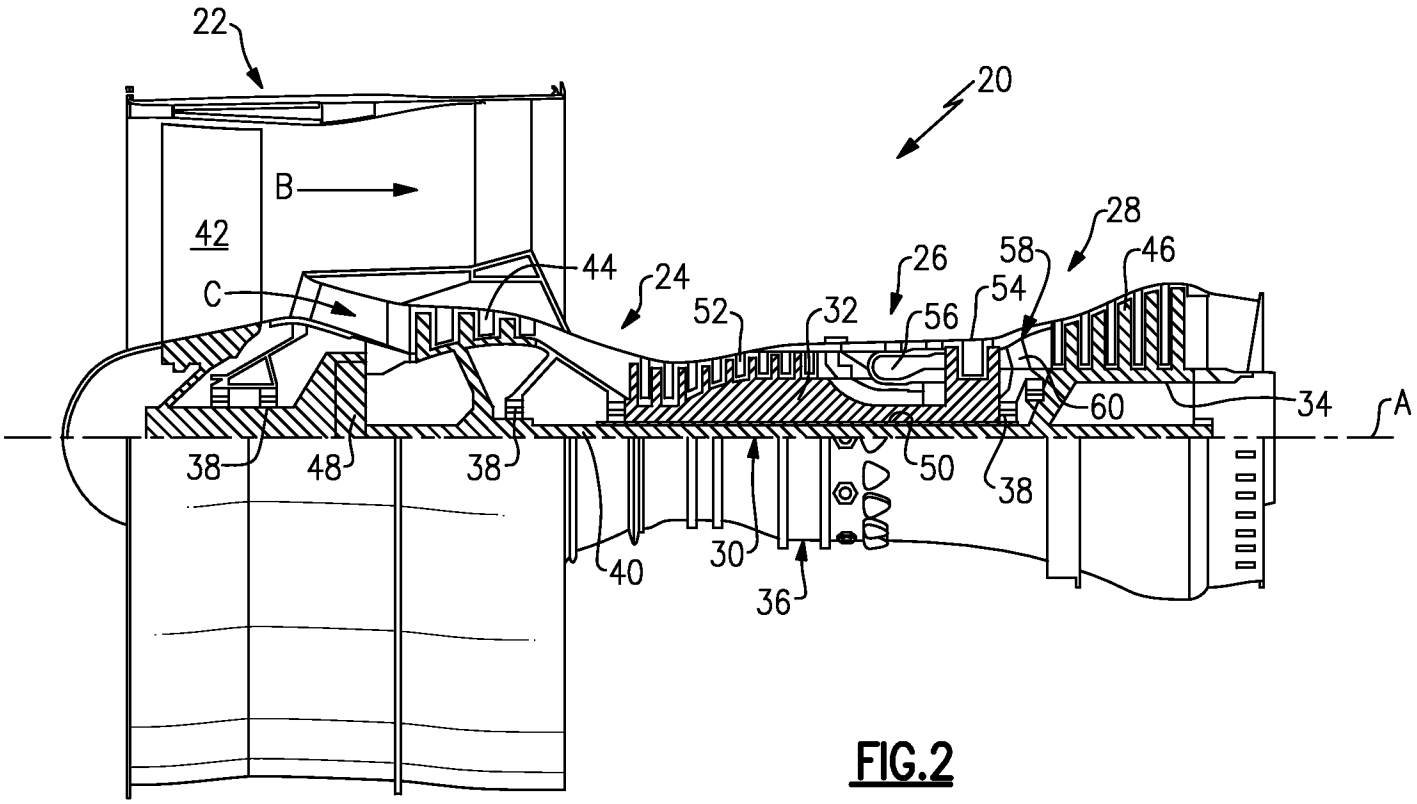
FIG. 2 schematically illustrates an example gas turbine engine.

FIG. 2 schematically illustrates an example gas turbine engine 20 that includes a fan section 22, a compressor section 24, a combustor section 26, and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about five (5). The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

The core airflow flowpath C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6:1), with an example embodiment being greater than about ten (10:1). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by air in the bypass flowpath B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment, the low fan pressure ratio is less than about 1.45.

"Low corrected fan tip speed" is the actual fan tip speed in ft/sec divided by an industry standard temperature correction of [(Tram ° R)/(518.7° R)]^0.5. The "Low corrected fan tip speed," as disclosed herein according to one non-limiting embodiment, is less than about 1150 ft/second.

The example gas turbine engine includes the fan 42 that comprises in one non-limiting embodiment less than about twenty-six (26) fan blades. In another non-limiting embodiment, the fan section 22 includes less than about twenty (20) fan blades. Moreover, in one disclosed embodiment the low pressure turbine 46 includes no more than about six (6) turbine rotors schematically indicated at 34. In another non-limiting example embodiment, the low pressure turbine 46 includes about three (3) turbine rotors. A ratio between the number of fan blades and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades in the fan section 22 disclose an example gas turbine engine 20 with increased power transfer efficiency.

Figure 3:
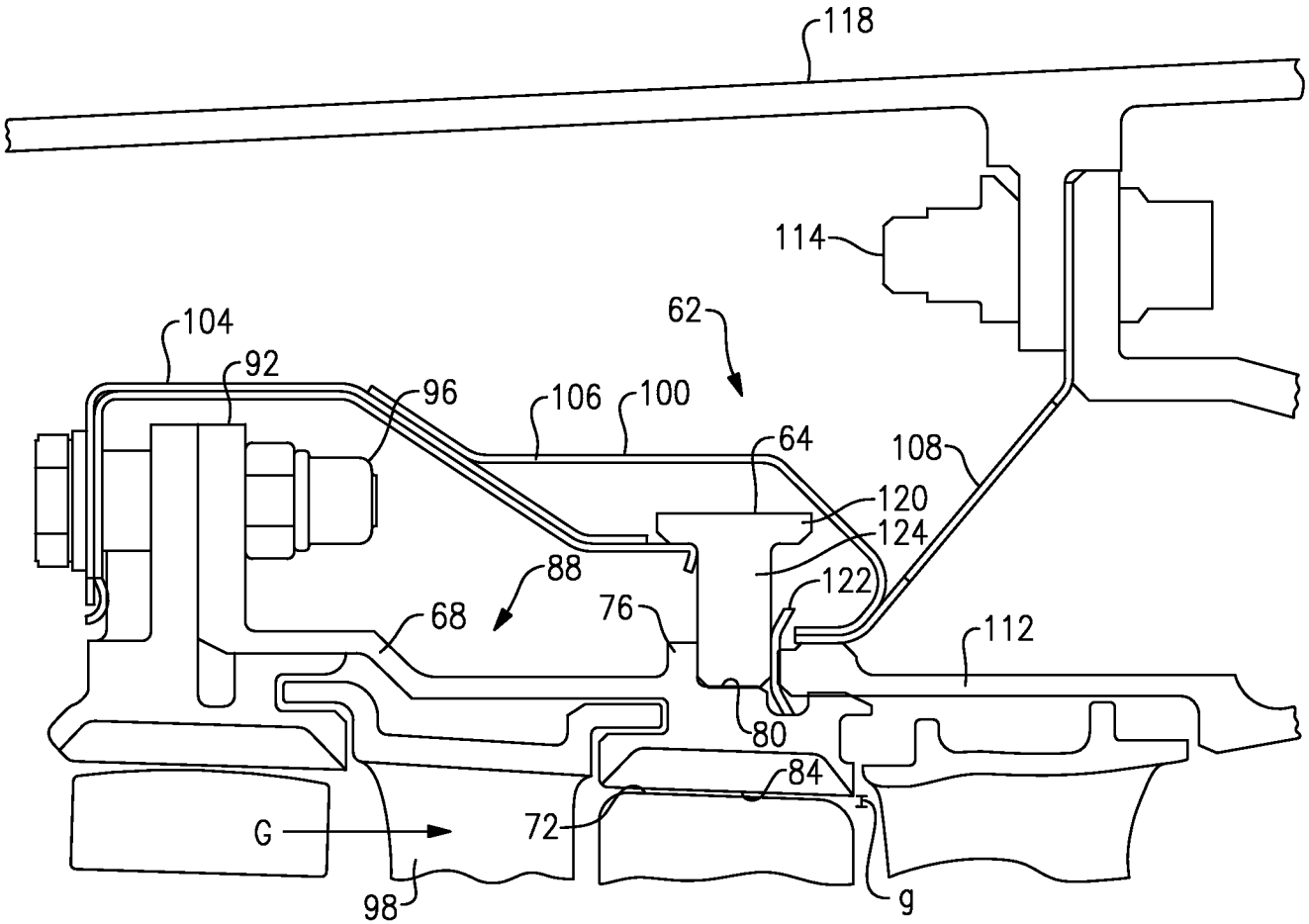
FIG. 3 shows a section view of a clearance control assembly in a high pressure compressor section of the engine of FIG. 2.
Figure 4:
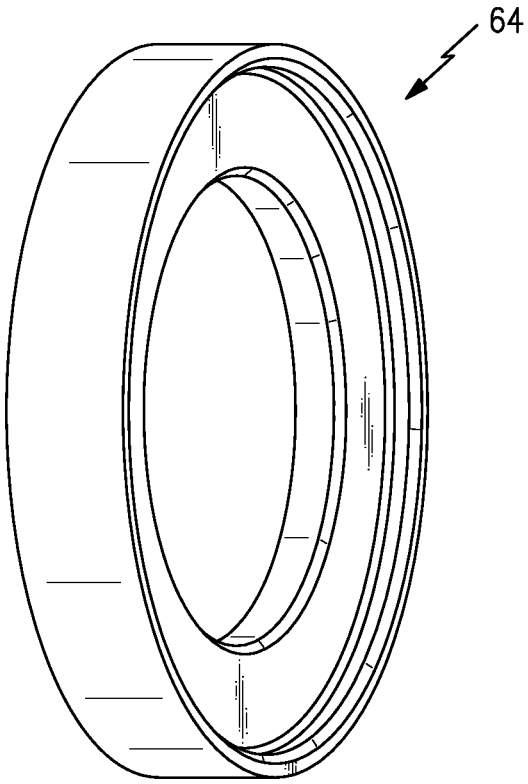
FIG. 4 shows a perspective view of an example clearance control ring for use in the clearance control assembly of FIG. 3.
Figure 5:
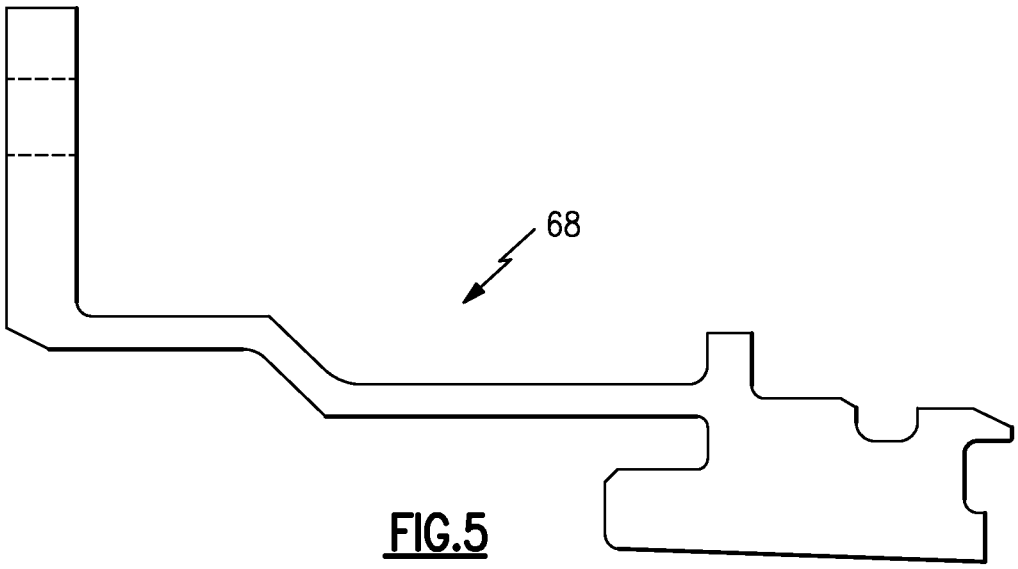
FIG. 5 shows an example blade outer air seal assembly that interfaces with the clearance control ring of FIG. 4.

Referring to FIGS. 3-5 with continuing reference to FIG. 2, an example clearance control assembly 62 includes a clearance control ring 64 that positions a blade outer air seal (BOAS) assembly 68 radially relative to a blade tip 72 of the gas turbine engine. The BOAS assembly 68 is pushed radially outward against the clearance control ring 64 during operation.

Thermal energy from the engine 20 causes the clearance control ring 64 and the BOAS assembly 68 to expand and contract. More thermal energy causes expansion, and less thermal energy causes contraction. In this example, a coefficient of thermal expansion of the clearance control ring 64 is less than a coefficient of thermal expansion of the BOAS assembly 68. The clearance control ring 64 and BOAS assembly 68 are sized such that radial outward movement of the BOAS assembly 68 is constrained by the clearance control ring 64.

When contracted, the clearance control ring 64 limits radial movement of the BOAS assembly away from the blade tip 72 to limit expansion of a gap g between the BOAS assembly and the blade tip 72. When expanded, the clearance control ring 64 permits more radial moment of the BOAS assembly away from the blade tip 72.

The clearance control ring 64 and the BOAS assembly 68 can be constructed of different materials or different combinations of materials to achieve the different coefficients of thermal expansion. The example clearance control ring 64 is constructed of a material that is intended to optimize clearance control. The material can be nickel-based or potentially other material types depending upon application needs. An example material for use with the clearance control ring 64 is a superalloy product sold under the trademark HAYNES®.

The example BOAS assembly 68 may be constructed from a material that is optimized for a high temperature area near a hot gas path G of the engine 20. An example material for use with the BOAS assembly 68 is a superalloy product sold under the trademark WASPALOY®.

The clearance control ring 64 may be a continuous annular structure that extends about the axis A of the engine 20. The clearance control ring 64, when installed, is positioned against a ring alignment flange 76 extending radially from other portions of the BOAS assembly 68. The clearance control ring 64, when installed, is, in this example, positioned radially against a control ring land 80 of the BOAS assembly 68. The control ring land 80 faces radially outward.

In addition to the control ring land 80, the BOAS assembly 68 further includes a seal portion 84, an axial span 88, and a radially extending fastener flange 92. A mechanical fastener 96, such as a bolt, secures the BOAS assembly 68 into position within the engine 20. The example mechanical fastener 96 is received through an aperture in the fastener flange 92.

In this example, the radially extending fastener flange 92 and the seal portion 84 are positioned on opposing axial sides of a blade 98 within the engine 20.

The mechanical fastener 96 may further secure a heat shield assembly 100 within the engine 20. In this example, the heat shield assembly 100 includes a forward-positioned heat shield 104, a mid-positioned heat shield 106 and an aft-positioned heat shield 108. The forward-positioned heat shield 104 extends from an end held by the mechanical fastener 96 to another end that rests against the clearance control ring 64. The forward-positioned heat shield 104 includes two layers in this example.

Also in this example, the mid-positioned heat shield 106 is connected to the forward-positioned heat shield 104 and extends from an area of the forward-positioned heat shield 104 to an area of the aft-positioned heat shield 108. The mid-positioned heat shield 106 extends from upstream the clearance control ring 64 to a position that is downstream the clearance control ring 64. The aft-positioned heat shield 108 extends from a point of contact with an inner diffuser case 112 of the engine 20 to a mechanical fastener 114 that secures the aft-positioned heat shield 108 to an outer casing 118 of the engine 20. The aft-positioned heat shield 108 is secured to the mid-positioned heat shield 106. The heat shield assembly 100 limits thermal energy movement and alters the transient response of the static structure within the area of the engine having the clearance control ring 64.

To position the clearance control ring 64 on the land 80 and against the ring alignment flange 76, the clearance control ring 64 can be heated relative to the BOAS assembly 68. This causes the clearance control ring 64 to expand radially such that the clearance control ring 64 can fit and slide into an installed position against the ring alignment flange 76. The clearance control ring 64 then cools and is compressed against the ring alignment flange 76.

In other examples, the clearance control ring 64 is slid axially onto the land 80 without being heated relative to the BOAS assembly 68. Thus, relative heating is not necessary to achieve a desired compression fit of the clearance control ring 64 to the BOAS assembly 68.

After positioning the clearance control ring 64 on the land 80, the inner diffuser case 112 is then assembled. The clearance control ring 64 is constrained axially between the ring alignment flange 76 and the inner diffuser case 112. A spacer 122 may, optionally, be utilized to bias the clearance control ring 64 toward, for example, the ring alignment flange 76. The spacer 122 effectively takes up axial space between the ring alignment flange 76 and the inner diffuser case 112 to prevent axial movement of the clearance control ring 64.

Radial movement of the clearance control ring 64 is limited due to the placement of the clearance control ring 64 on the land 80.

Notably, the clearance control ring 64 is mechanically unfastened from any other portion of the gas turbine engine 20. That is, no mechanical fasteners are used to secure the clearance control ring 64. Mechanical fasteners, in some examples, would limit the ability to alter mass of the clearance control ring 64. Mechanically fastened structures, such as bolted assemblies, can require longer assembly time and may induce stress concentrations verses mechanically unfastened assemblies.

The example clearance control ring 64 has a generally "T" shaped cross-section. The clearance control ring 64 can include a cap portion 120 and a stem portion 124 that is radially inside the cap portion 120. The step portion 124 has an axial width that is less than the cap portion 120. In this example, portions of the heat shield assembly 100 directly contact the clearance control ring 64 under the cap portion 120. Also, the axial front and axial rear of the example clearance control ring are symmetrical, which allows the clearance control ring 64 to be assembled from either direction.

The example clearance control ring 64 is utilized to control tip clearances within the eighth stage of the high pressure compressor section of the engine 20. In other examples, the clearance control ring 64 is used in other stages of the engine 20.

During engine operation, the hot gas path G heats the BOAS assembly 68 and the clearance control ring 64. The material differences between the clearance control ring 64 and the BOAS assembly 68 enable the clearance control ring 64 to control radial movement of the BOAS assembly 68 and thus control tip clearances between the blade tip 72 and the seal portion 84. During the design process, relatively, quick and simple adjustments may be made to the size of the clearance control ring 64 to alter how the clearance control ring 64 responds thermally and controls clearances.

Features of the disclosed examples can include a clearance control assembly utilizing fewer parts. Relatively high stress bolt holes and scallops are reduced or eliminated, which improves durability. Machining time, assembly time, and finite element analysis time are also reduced.

Although an embodiment of this invention has been disclosed, a worker of ordinary skill in this art would recognize that certain modifications would come within the scope of this invention. For that reason, the following claims should be studied to determine the true scope and content of this invention.

We claim:

1. A clearance control assembly for a gas turbine engine, comprising:

a clearance control ring to position a blade outer air seal assembly radially relative to a blade tip, wherein the clearance control ring is compression fit to the blade outer air seal assembly; and a heat shield having a portion radially outside the clearance control ring and a portion that directly contacts the clearance control ring.

2. The clearance control assembly of claim 1, wherein the clearance control ring is compression fit to a radially outward facing land of the blade outer air seal assembly.

3. The clearance control assembly of claim 1, wherein the clearance control ring is positioned axially between a radially extending flange of the blade outer air seal and an inner diffuser case.

4. The clearance control assembly of claim 1, wherein the clearance control ring has a generally "T" shaped cross section.

5. The clearance control assembly of claim 1, wherein the clearance control ring comprises a cap portion and a stem portion extending radially from the cap portion, the stem portion having an axial width that is less than an axial width of the cap portion.

6. The clearance control assembly of claim 5, wherein the stem portion is radially inside the cap portion.

7. The clearance control assembly of claim 1, wherein the clearance control ring is mechanically unfastened.

8. A clearance control assembly for a gas turbine engine, comprising:

a blade outer air seal assembly mechanically fastened to a gas turbine engine structure;

a clearance control ring to position the blade outer air seal relative to an array of blade tips, the clearance control ring being compression fit to the blade outer air seal; and a heat shield radially outside the clearance control ring, the heat shield including a portion directly contacting the clearance control ring.

9. The clearance control assembly of claim 8, wherein the blade outer air seal assembly comprises an axial span connecting a seal portion to a fastener flange.

10. The clearance control assembly of claim 9, wherein the fastener flange is positioned upstream a vane array relative to a direction of flow through the gas turbine engine and the seal portion is positioned downstream the vane array.

11. The clearance control assembly of claim 8, wherein the blade outer air seal assembly includes a ring alignment flange that limits movement of the clearance control ring in a first axial direction.

12. The clearance control assembly of claim 11, including a spacer that limits movement of the clearance control ring in a second axial direction opposite the first axial direction.

13. The clearance control assembly of claim 12, wherein the spacer is positioned axially between an inner diffuser case and the clearance control ring.

14. The clearance control assembly of claim 8, wherein blade outer air seal comprises a first material having a first coefficient of thermal expansion, and the clearance control ring comprises a second material having a second coefficient of thermal expansion that is different than the first coefficient of thermal expansion.

15. The clearance control assembly of claim 14, wherein the second material comprises a superalloy.

16. A method of controlling blade tip clearances within a gas turbine engine, comprising:

compression fitting a clearance control ring to a blade outer air seal assembly;

contracting the clearance control ring to limit radial expansion of the blade outer air seal; and contacting the clearance control ring with a heat shield, the heat shield including a portion that is radially outside the clearance control ring.

17. The method of claim 16, limiting axial movement of the clearance control ring using a flange extending radially from the blade outer air seal assembly.

18. The method of claim 16, including mechanically fastening the blade outer air seal to a gas turbine engine structure at a first position, and contacting the clearance control ring at a second position, the first and second positions on opposing axial sides of a vane of the gas turbine engine.

* * * * *